United States Patent [19]

Yoshizawa

[11] 4,150,844

[45] Apr. 24, 1979

[54] HANDY NOTEBOOK FOR ADDRESSES

[75] Inventor: Iwao Yoshizawa, Tokyo, Japan

[73] Assignee: Yoshizawa Kobundo, Tokyo, Japan

[21] Appl. No.: 833,147

[22] Filed: Sep. 14, 1977

[30] Foreign Application Priority Data

Aug. 21, 1976 [JP] Japan ..... 51-58565

[51] Int. Cl.[2] ..... B42D 3/04

[52] U.S. Cl. ..... 281/19 R; 281/34

[58] Field of Search ..... 281/15 R, 19 R, 21 R, 281/34, 35, 29, 1

[56] References Cited

U.S. PATENT DOCUMENTS

| | | | |
|---|---|---|---|
| 411,315 | 9/1889 | Williams | 281/15 R |
| 592,981 | 11/1897 | Bowker | 281/15 R |
| 967,438 | 8/1910 | Richardson | 281/1 |
| 2,310,725 | 2/1943 | Widder et al. | 281/15 R |
| 3,140,883 | 7/1964 | Anthony | 281/34 |
| 3,572,767 | 3/1971 | Learned et al. | 281/34 |

*Primary Examiner*—Frank T. Yost

*Attorney, Agent, or Firm*—Flynn & Frishauf

[57] ABSTRACT

A notebook for addresses comprises a base plate folded in two, a plurality of paper slips for records, each paper slip being folded in two at a substantially central transverse line so as to form front and rear flaps, said paper slips being steppedly arranged and attached to the base plate, and a cover having two pockets into which both end portions of the base plate are inserted. Preferably the cover has a transparent flap portion for showing therethrough indices printed to the end of the paper slip.

15 Claims, 8 Drawing Figures

FIG. 1
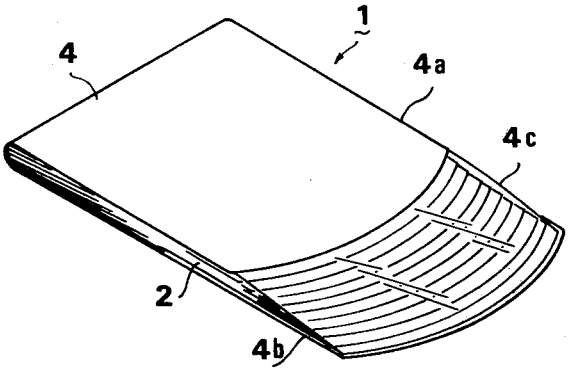
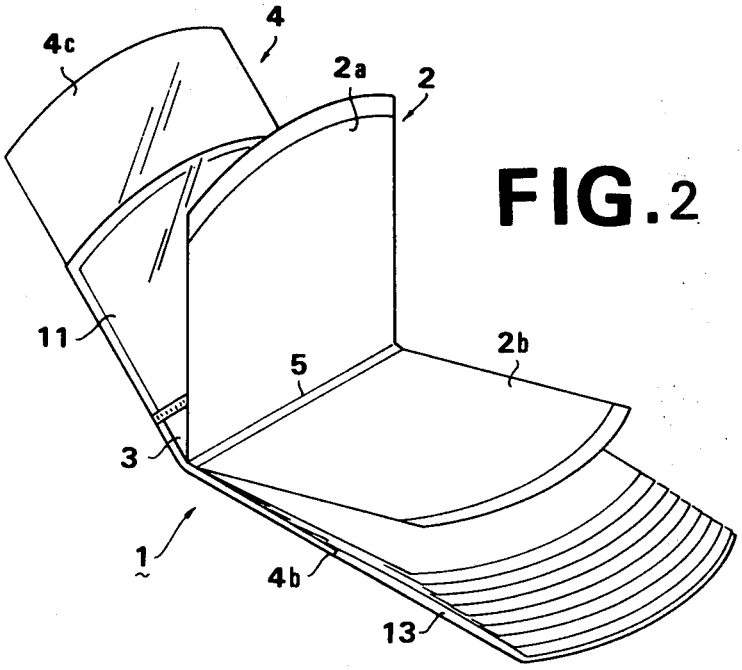
FIG. 2

HANDY NOTEBOOK FOR ADDRESSES

BACKGROUND OF THE INVENTION

This invention relates to a notebook for addresses, and more particular to an improved handy notebook for address having twice recording spaces.

Generally, the prior notebook for addresses has a plurality of paper slips for records, each of which has an index space formed at the edge thereof and steppedly arranged, and which are adhesively secured to a base plate at the other edges thereof, so that two recording spaces on each slip are at the front and rear surfaces thereof.

Nevertheless, the user has not be satisfied with the two recording spaces for each index, because the square size of the handy notebook is unavoidably restricted in reality for suitable or conformable handling.

SUMMARY OF THE INVENTION

An object of this invention is to provide a handy notebook for addresses so improved that each of the paper slips provides four recording spaces for each index.

In accordance with the invention the same number of paper slips as the number of indices are each folded in two with each folded sheet having a narrow adhering area adjacent to the folded line so as to be adhered to a common base plate.

Another object of this invention is to provide a handy notebook for addresses which includes a two-folded base plate adapted to support paper slips for records, said base plate having an adhesive surface on the outer surface, said outer adhesive surface being covered by a protective sheet detachably attached to the base plate, and a transparent cover having two pockets into which are inserted both free end portions of the base plate.

BRIEF DESCRIPTION OF THE DRAWINGS

FIG. 1 is a perspective view of a notebook embodying this invention;

FIG. 2 is a perspective view of the notebook of FIG. 1 illustrated in a half open condition;

DETAILED DESCRIPTION

Figure 3:
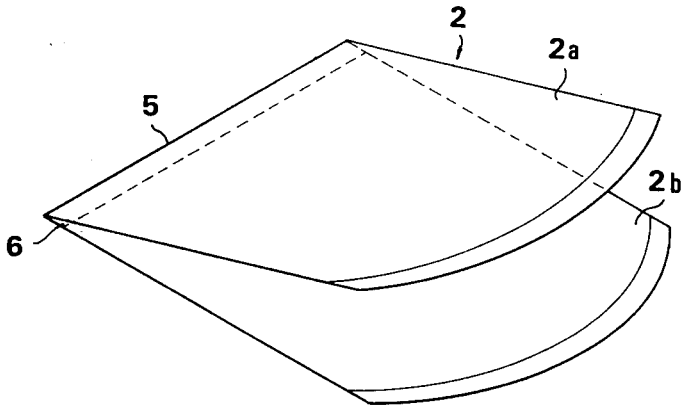
FIG. 3 is a perspective view of a paper slip folded at its center transverse line, which includes four recording spaces for each index.

Referring to FIGS. 1 and 2, the notebook 1 comprises an assembly of paper slips 2, a base plate 3 made of cardboard to which said slips 2 are attached, and a cover 4 made of plastic resin such as vinyl.

Each of the paper slips 2 is folded in two at its center transverse line 5 so as to form two flaps **2*a* and 2*b* with four recording spaces. At the end edge of the front space of the flap 2*a*** is printed a suitable code to serve as an index.

Figure 4:
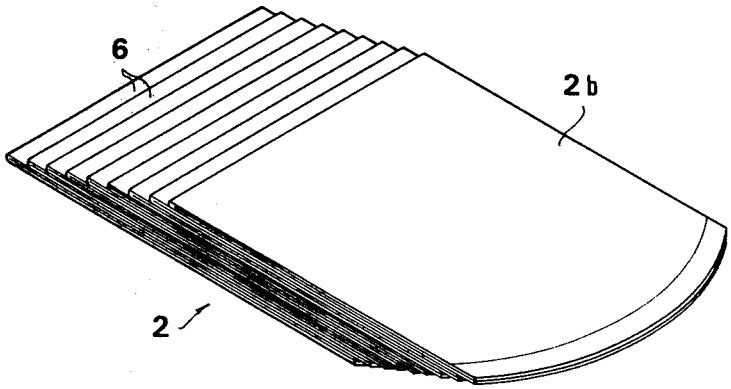
FIG. 4 is a perspective view of an assembly of the strips steppedly arranged to each other.

Each of the paper slips 2 has a narrow adhering area 6 adjacent to the cross line 5, and the paper slips 2 are steppedly arranged as shown in FIG. 4 wherein the adhering areas 6 of the strips are adjacent each other. The adhering areas 6 may be self-adhesive areas.

Figure 5:
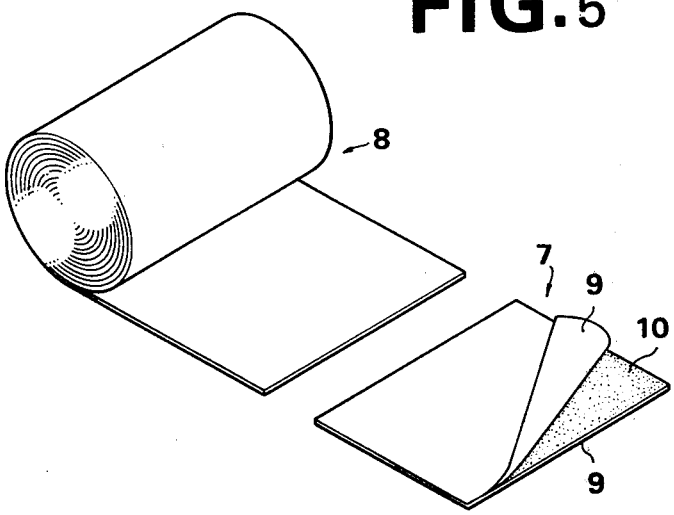
FIG. 5 is a perspective view of a square strip cut off from a wound tape having both adhesive faces covered by laminae removable from the tape body, which is called a "TACK SHEET"

A square strip 7 is cut off, as shown in FIG. 5, from a wound tape 8 having both adhesive faces covered by laminae 9 removable from the strip body 10. Such tape 8 is generally called a "TACK SHEET".

Figure 6:
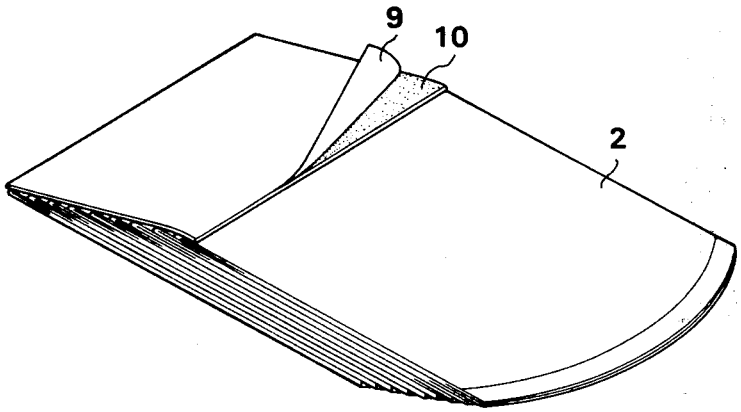
FIG. 6 is a perspective view of a condition where one lamina is removed from the surface thereof, and the exposed surface is adhesively connected to the gathered adhering areas of the paper slips.
Figure 7:
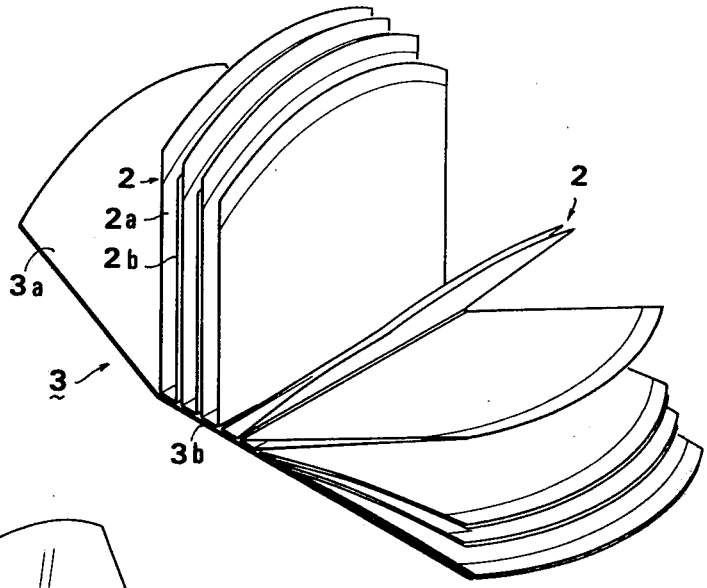
FIG. 7 is a perspective view of the strip assembly with the adhesive square strip adhesively connected to the base plate as the other lamina is removed.

After one of the laminae 9 is detached, the exposed adhesive surface of the strip body 10 is attached to the adhering areas 6 so as to assemble the paper slips 2 to the strip body 10, as seen in FIG. 6. Then the other of the laminae 9 is uncovered so that the newly exposed surface of the strip body 10 is adhesively connected to the suitable portion of the plate 3, as seen in FIG. 7.

The square strip 7 may be so used as to be firstly attached to the base plate 3 after one of the laminae 9 is uncovered, and nextly adhered to the adhering spaces or areas 6 after the adhesive surface of the strip body 10 is exposed by removing the other of the laminae 9.

The base plate 3 is folded in two so as to be formed into a front portion **3*a* with a short length and a rear portion 3*b*** with a long length.

Figure 8:
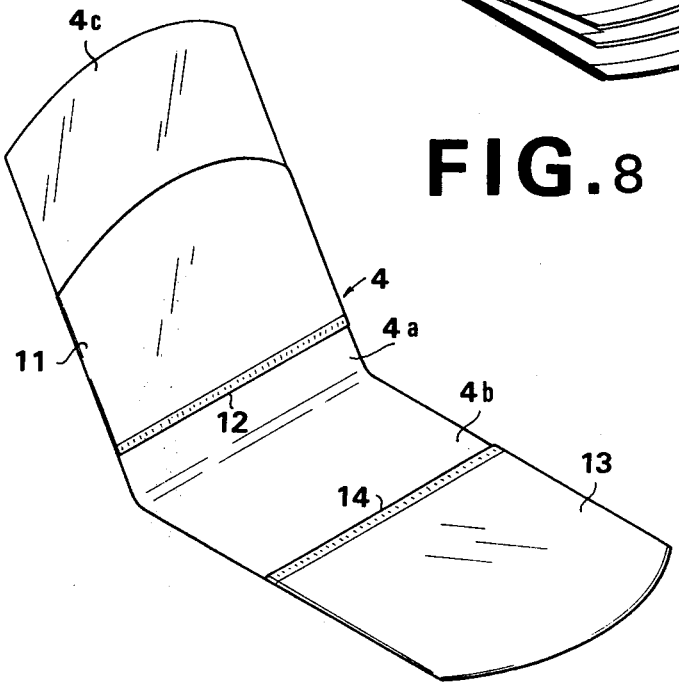
FIG. 8 is a perspective view of a cover removed from the notebook body.

As seen in FIG. 8, the cover 4 is folded in two to be separated into front and rear portions **4*a* and 4*b*. The front portion 4*a* includes a transparent sheet 11 heat-adhered to the cover body so as to form a pocket 12 to the inside of the cover 4 for containing the front portion 3*a* of the base plate 3. The heat-adhesion in this embodiment extends to the end edge and both side edges of the front portion 4*a*, so that the non-duplicated portion 4*c* remains. The rear portion 4*b* includes a transparent sheet 13 heat-adhered to the cover body so as to form a pocket 14 for containing the rear portion 3*b* of the base plate 3, in such manner to engage the three edges of sheet 13 with the end edge and both side edges of the rear portion 4*b***.

If necessary, the front portion **4*a* may be constituted the same as the rear portion 4*b* mentioned above in the case where the cover 4** is all of transparent resinous material.

In the case where the cover 4 is formed of transparent material, the outer surface of the base plate 3 should be given a suitable color or pattern to serve as an appropriate design for the cover.

In this embodiment, the base plate 3 has an improved construction as mentioned hereinafter. Namely, the base plate 3 includes an adhesive surface thereof covered by a protecting sheet, i.e., a lamina, which is preferably given with a suitable pattern printed or design so as to be seen through the transparent cover 4. When the user expects to make an original design on the cover, the protecting sheet is detached and then a separate sheet including his original design or, his selected design pattern is attached to the exposed adhesive surface of the base plate 3. Accordingly, it is important that the base plate 3 has the adhesive surface on the outer surface coated by bonding material, and generally to cover the surface by the protecting sheet.

The notebook for addresses of this invention specially includes twice as many memory spaces per index as the prior art notebook.

What is claimed is:

1. A notebook comprising:

a base plate folded in two so as to form a front portion with a given short length and a rear portion with longer length;

a plurality of substantially identically sized paper record slips, each of which is folded in two at a substantially central transverse fold line thereof so as to form front and rear flaps of substantially the same length, said record slips all providing substantially the same record area;

said paper slips being steppedly and sequentially arranged and attached adjacent each other to the inside surface of said rear portion of said base plate in the vicinity of their respective transverse fold lines, said fold lines of said attached paper slips being arranged adjacent each other along a predetermined length of said rear portion of said base plate; and a cover having front and rear flaps, each flap having respective pockets into which said front and rear portions of said base plate are respectively inserted.

2. The notebook of claim 1 further comprising an adhesive strip having two adhesive faces covered by respective removable laminae, said paper slips being adhered to said strip in said stepped sequential arrangement, and said strip being adhered to said base plate upon removal of said laminae.

3. The notebook of claim 1 wherein said base plate includes an adhesive outer surface removably covered by a protecting sheet.

4. The notebook of claim 3 wherein said cover is completely transparent.

5. The notebook of claim 3 wherein said adhesive outer surface of said base plate comprises a bonding material coated thereon, said protecting sheet removably covering said bonding material.

6. The notebook of claim 1 wherein said cover is completely transparent.

7. The notebook of claim 1 wherein each of said paper slips has an adhering area adjacent to said substantially central transverse fold line, said adhering areas being adhered to the inside surface of said rear portion of said base plate.

8. The notebook of claim 7 wherein said adhering areas of each of said paper slips are substantially flat adhering areas extending a small distance from said respective substantially central transverse fold lines in a direction perpendicular to said respective fold lines.

9. The notebook of claim 1 wherein each of said paper slips has an index indicia printed on an edge thereof, said index indicia of each slip being exposed when said attached slips are folded flat against said rear portion of said base plate; and wherein at least one of said flaps of said cover comprises a transparent flap portion which overlies said index indicia so that said index indicia can be seen therethrough.

10. The notebook of claim 9 wherein said front flap of said cover comprises said transparent flap portion which is adjacent the pocket of said front flap.

11. The notebook of claim 9 wherein said base plate includes an adhesive outer surface removably covered by a protecting sheet.

12. A notebook comprising:

a base plate folded in two so as to form a front portion with a given short length and a rear portion with a longer length;

a plurality of paper record slips, each of which is folded in two at a substantially central transverse fold line thereof so as to form front and rear flaps of substantially the same length;

said paper slips being steppedly and sequentially arranged and attached adjacent each other to the inside surface of said base plate in the vicinity of their respective transverse fold lines, said fold lines of said attached paper slips being arranged adjacent each other along a predetermined length of the inside surface of said base plate;

said base plate including an adhesive outer surface which is removably covered by a protecting sheet, said adhesive outer surface comprising a bonding material coated on said outer surface of said base plate; and a cover having front and rear flaps, each flap having respective pockets into which said front and rear portions of said base plate are respectively inserted.

13. The notebook of claim 12 wherein said paper slips are attached to the inside surface of said rear portion of said base plate.

14. The notebook of claim 13 wherein each of said paper slips has an adhering area adjacent to said substantially central transverse fold line, said adhering areas being adhered to the inside surface of said rear portion of said base plate.

15. The notebook of claim 14 wherein said adhering areas of each of said paper slips are substantially flat adhering areas extending a small distance from said respective substantially central transverse fold lines in a direction perpendicular to said respective fold lines.

* * * * *